US005542870A

United States Patent [19]

Westersund

[11] Patent Number: 5,542,870

[45] Date of Patent: Aug. 6, 1996

[54] FOLDING BOX DIORAMA TOY

[76] Inventor: Curtis D. Westersund, #255-801 6 St SW., Calgary, Alberta, Canada, T2P 3V8

[21] Appl. No.: 272,703

[22] Filed: Jul. 7, 1994

[51] Int. Cl.[6] ..... A63H 33/00

[52] U.S. Cl. ..... 446/75; 446/487; 446/478; 220/6; 220/324

[58] Field of Search ..... 446/487, 478, 446/75; 220/7, 6, 324; 206/45.23, 45.21, 45.2

[56] References Cited

U.S. PATENT DOCUMENTS

| | | | |
|---|---|---|---|
| 1,181,825 | 5/1916 | Bartelt | 446/478 |
| 2,490,296 | 12/1949 | Fournier | 220/6 X |
| 3,789,522 | 2/1974 | Moore | 446/478 X |
| 4,522,312 | 6/1985 | Rathgeber et al. | 220/324 |
| 4,755,159 | 7/1988 | Templeton et al. | 446/478 X |

FOREIGN PATENT DOCUMENTS

| | | | |
|---|---|---|---|
| 2159721 | 12/1985 | United Kingdom | 446/487 |

*Primary Examiner*—Mickey Yu

*Attorney, Agent, or Firm*—Skjerven, Morrill, MacPherson, Franklin & Friel; Brian D. Ogonowsky; Thomas S. MacDonald

[57] ABSTRACT

A folding box dioramic toy has a rectangular base panel for displaying central scenic structures and rectangular side panels hinged thereto also displaying scenery. The side panels include integral triangular members extending orthogonally therefrom which in a box closed mode form a closed box top and in an unfolded mode provide vertical back-drops for additional scenery or structures. The scenery and structures show a diorama, such as a medieval castle and outbuildings, such that a child can place and move toy archers, horse-mounted knights and villagers around while playing an imaginative interactive play game. The panels and hinge elements are all snap-connected. The apex of each triangular member terminates in a quarter-ball segment and contains in the closed mode a circumferential groove into which a flexible latch loop or ring mounted on one of the triangular members can be pushed locking the resultant locking dome. Temporary locking is provided by a ridged tab extending from the apex of one triangular member which engages a detented slot on the apices of the other triangular members.

10 Claims, 8 Drawing Sheets

39a
63
B
22
74
A
15a
15b
73
72
53
54
39b
16b
75
23
34
62
16a
26
53
61
76
71
62
77
70
62
60
62
53
55
54
C
54
73d
73c
73b
73a
78
75
12b
12a
51
52
63a
24a
90
24b
F
53
14b
14a
62
D
E
62

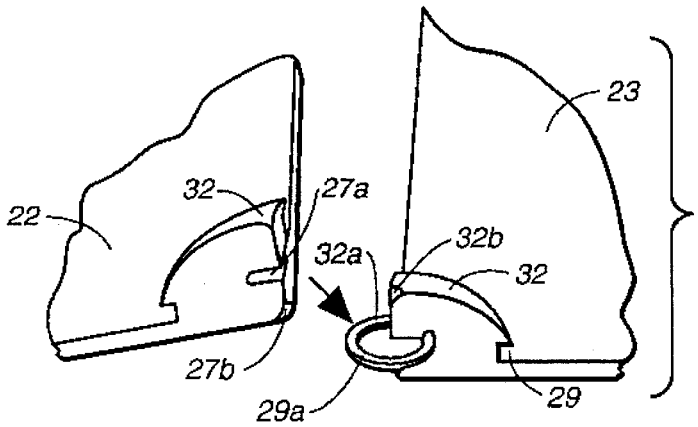
FIG._14
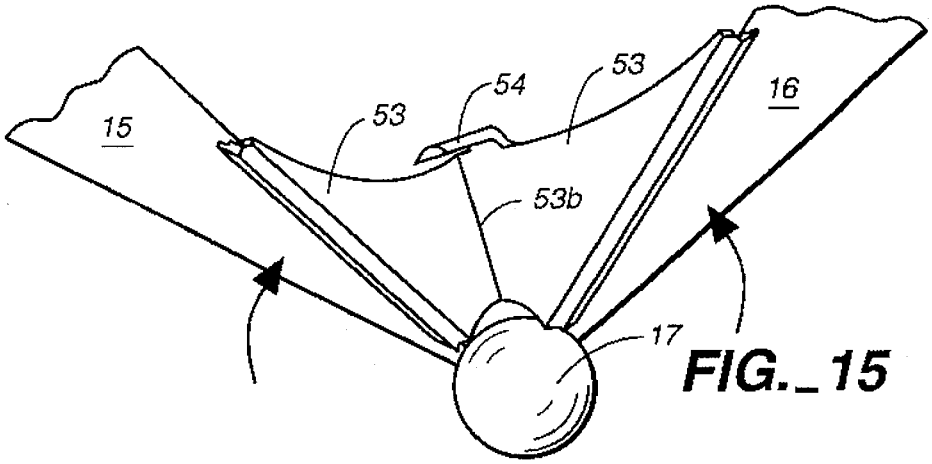
FIG._15
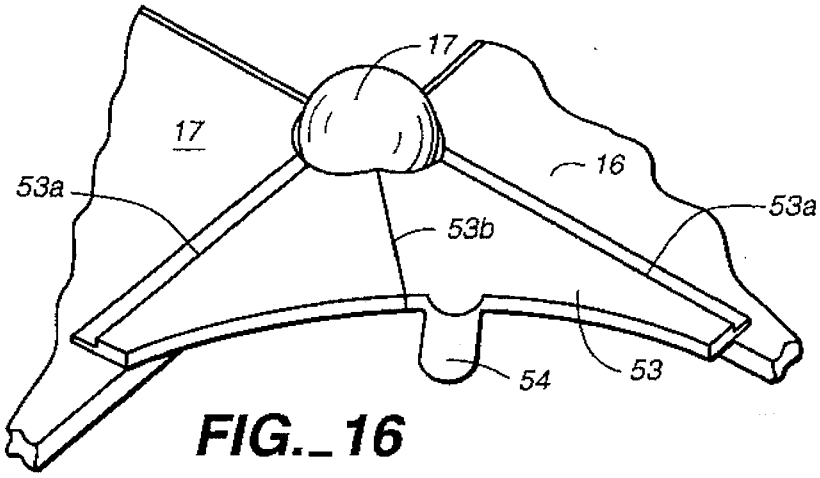
FIG._16
FIG._17
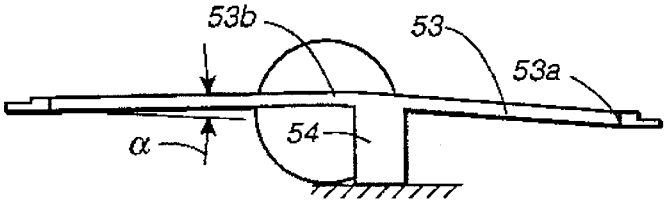

FOLDING BOX DIORAMA TOY

RELATED APPLICATION

A Design application Serial No. 29,025,821, filed Jul. 7, 1994, entitled "Folding Box Dioramic Toy" Inventor: Curtis D Westersund has been filed herewith, the contents thereof being incorporated herein by reference.

FIELD OF THE INVENTION

This invention pertains to a fold-out scenery box assembly. More particularly the invention is directed to a child's toy where a box is unfolded to expose a scenic display in which a child can manipulate toy objects in a natural setting for those objects, using the child's play imagination.

BACKGROUND OF THE INVENTION

Dioramic displays involving scenic representations in which sculptured figures and lifelike details are displayed usually in miniature so as to blend indistinguishably with a realistic painted background have been prepared for viewing for centuries. Such diorama have also been used as toys where numerous scenes are represented on a flat board and a child can move the figures or objects around, such as toy soldiers on a battlefield or toy cars around a speedway. A problem with such boards is that they are not easily stored or transported by the child or the parent. These prior art dioramas due to their size are also difficult to merchandise and must be put in large flat unwieldy boxes for display. It is understood that certain so-called Micromega™ toys have been sold by others where an auto van-like toy has latched sides which flop down to expose a city interior. Somewhat similarly it is understood that a Ninja Turtle toy apparently known as a TeknaDrome toy has been sold involving a tank-tracked ball which can be hingedly opened to expose scenery in the form of an "enemy lair". Both of these toys provide for very structured play for mostly school-aged children. There thus has been a need for a more imaginative more easily used diorama where one or more young particularly pre-school children can easily remove from storage, carry, open to greatly expand the area of scenic play, to interactively play on the diorama, then close and return the toy to storage.

SUMMARY OF THE INVENTION

The present invention of a folding and unfolding dioramic toy is a toy which beckons the child, is dynamic and futuristic in its appearance, and develops manipulative skills and teaches the use of simple mechanisms in the folding and unfolding operations. Once unfolded the diorama toy permits the manipulation of toy objects be they animals, vehicles or human figures or the like, in an exposed natural undulating landscape, with or without replicas of man-made physical structures, paths or streets so as to let the child's imagination reign and roam in moving toy objects about the landscape, scenery and structures, particularly while interactively playing in an unstructured manner with another child.

The diorama toy of the invention is an essentially cubic box assembly where the four box sides are hingedly mounted to a box base panel, the hinges preferably being in the form of corner ball segments which in both the folded and unfolded modes of operation act as corner knobs for supporting the base panels (and the side panels in the unfolded mode of operation) above a floor or rug surface as a raised platform or stage. The balls also give a great degree of stability to the toy when the toy is resting on a rug surface. When the side panels are fully unfolded and essentially flat an indented space is provided between each side panel in which the child may kneel or rest an arm without having a problem in reaching into the scene to place or move a toy object.

Each of the side panels has an integral triangular member having a base extending across the side panel top edge and preferably equally sized side edges which fit together with adjacent triangular members to form the box assembly top. The triangular members are preferably orthogonal to the side panels so as to form a flat-top of the box in the closed position and vertical scene backdrops in the unfolded mode. A latching dome is formed at the apices of the triangular members which in a box folded (box closed) mode may be captured by a plastic locking ring fixedly attached to one of the triangular members to temporarily lock the box assembly. A temporary latch is also provided for use generally when two or more adjoining side panels and their integral triangular members are in a raised closed position. A side carrying-handle including a finger-groove and grasp bar is integrally molded in one or more of the side panels at a top edge and its integral triangular member to permit lifting and transport of the folded box assembly.

Interior scenery is provided vertically extending from the top interior of the base panel, also extending horizontally from the interior of each side panel (becoming vertical while unfolded) and also depending vertically or facing downwardly from the interior of the triangular members in the box closed mode and extending horizontally from the then vertical orientation of triangular members in a box assembly unfolded mode. The base panel may mount a prominent high structure approaching the interior vertical height of the box assembly interior less the depending height of scenes extending downwardly in the interior of the box from the triangular members in the box assembly folded mode. In both the box assembly folded mode and unfolded mode the ball segments are curved and thus abrasions or snagging of clothes on the structure is minimized. The bottom ball structures include molded-in hinge sockets which hingedly interact with molded-in pins extending from the corners at the bottom of the side panels.

Upper ball structures are provided at the juncture of the respective side panel top corners. Each panel has a closed locking ball shell and an open locking ball receptacle or shell for receiving and a locking the closed ball. A snap-in and snap-out flexible locking detent and aperture is provided on facing surfaces of the ball receptacle and the closed shell to temporarily locked the side panels together. Snap-in folding wings are attachable to bottom side portions of adjacent side panels to form a fanciful curved landscape-containing transition zone between the orthogonal edges of the side panels in an unfolded mode.

In a preferred embodiment both the base panel and the side panels, (including the triangular members) each include two nesting panels, and outer panel and an inner panel The interior panels include the landscape and structural scenery molded in-place and/or painted on the interior surface of the respective interior panels. The respective outer and inner panels are snapped together with a series of snap-in posts and matching apertures in facing surfaces of the panels. This permits the use of standard panels for the exterior base panel and the exterior side panels with the interior panels having a variety of scenery and structures thereon being quickly snapped-in place to form the finished box assembly. The exterior panels contain printed indicia with opening and closing and play instructions as well as colorful visual and written recitations of those activities which are possible within the box. The initially unopened box will also contain a supply of the toy objects which the child will utilize in interacting with the scenes and structures displayed in the unfolded box assembly.

BRIEF DESCRIPTION OF THE DRAWINGS

FIG. 14 is a perspective view of a temporary lock for the box top quadrants.

FIG. 15 is a perspective view showing the folding wing in the being folded condition.

FIG. 16 is a perspective of a second folding wing embodiment in the unfolded, diorama open condition.

FIG. 17 is a side view of the folding wings at a shallow angle to enable desired wing folding.

DETAILED DESCRIPTION

Figure 1:
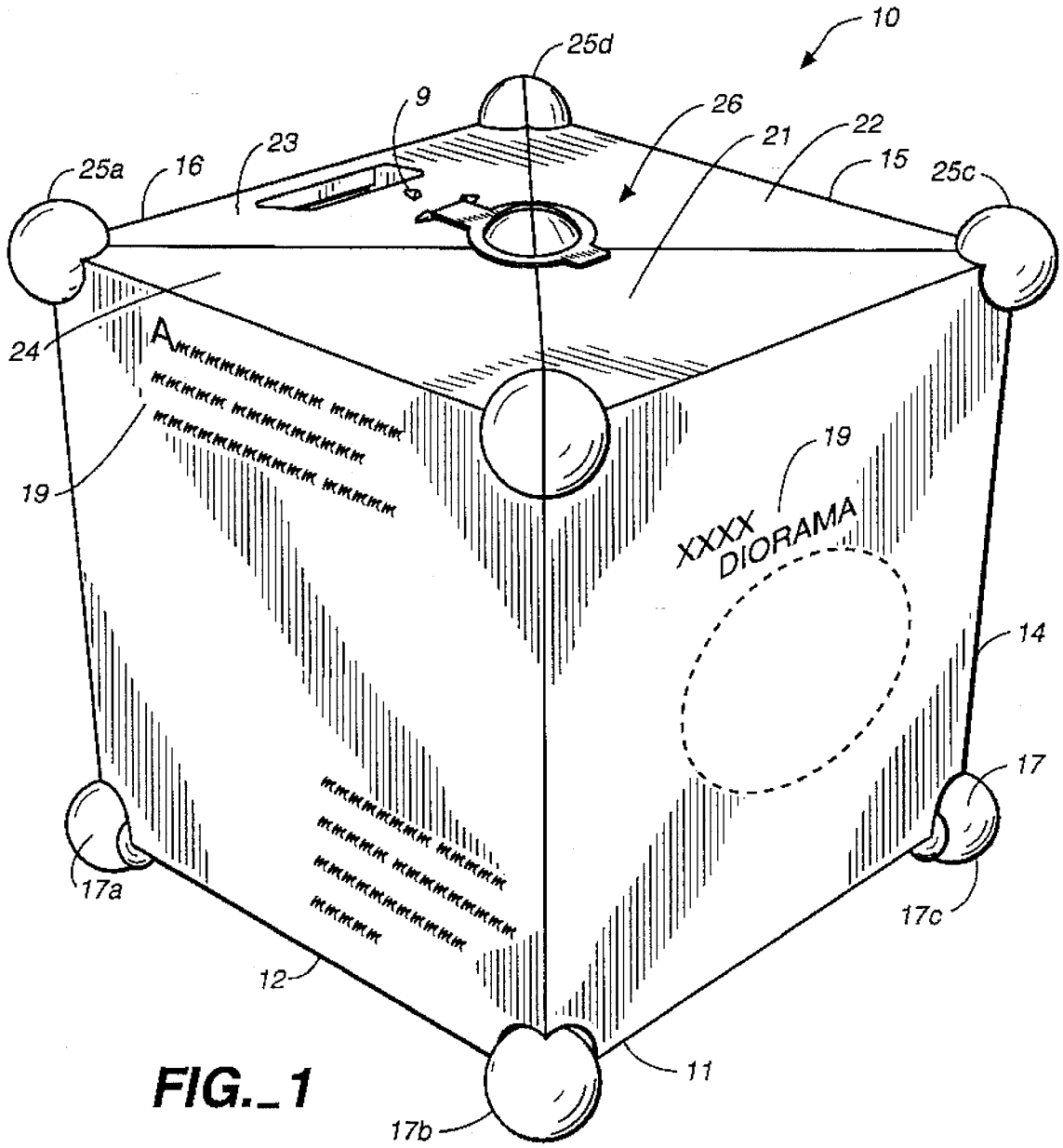
FIG. 1 is a perspective view of the diorama box of the invention in the folded closed mode and showing indicia describing the box contents.
Figure 12:
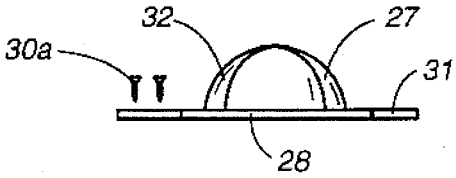
FIG. 12 is a top view of the latching dome.
Figure 13:
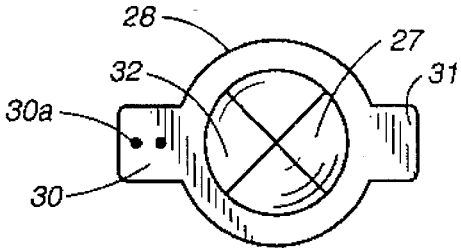
FIG. 13 is a side view thereof with the locking ring in unlatched position.

As seen in FIG. 1 the folding and unfolding dioramic toy 10 is in the form of a box assembly having a base panel 11 and hinged side panels 12, 14, 15 and 16. Integrally connected to the top edge of each side panel is a triangular member 21, 22, 23 and 24. Preferably the triangular members 21–24 extend orthogonally from their respective side panels 14, 15, 16 and 12 so as to form a flat box top. In a box assembly folded or sometimes called herein a box closed mode or closed position, the apex of each triangular number interfits or is relatively flush with the apices of the other triangular members. The unconnected sides of the triangular members are of equal angle and length. A locking mechanism 26 including a dome 27 (FIG. 2) including four quarter domes 32 (FIG. 12), is formed at the apex of the triangular members. The resultant locking dome has a circumferential groove or indent 29. A flexible plastic locking ring 28 (FIGS. 12 and 13) has one end 30 anchored to a triangular member e.g. member 23 by a suitable fastener such as staked pins 30*a*, and a free tab end 31 is pivotable about the staked end so that the flexible latch loop or ring 28 can be pushed down over the dome and into the groove to lock the quarter domes 32 together. The end 30 may be pivoted about a pivot pin having the pin ends staked to the member 23. Lifting the tab end 31 easily removes the ring from the groove allowing a child to then unfold and open the box. A locking tab 9 may be positioned on triangular member 23 which is adapted to receive and hold in an interference fit an inner edge of the ring 28 aperture when the ring is pivoted 180° from the box locking mode to the box open mode. Other closure means may be employed.

A series of hinge members 17 or knobs preferably in the form of ball segment members 17*a*, 17*b*, 17*c* and 17*d* are provided at each bottom corner of the box. These segment members also function to support the box base panel above a floor or rug or table playing position both in a box folded (closed) mode and box unfolded (open) mode. The corner supports which concentrates the weight of the box assembly and its scenery at the corners over a small area will stabilize the box in both modes, and particularly when on a rug surface will minimize sliding.

Figure 5:
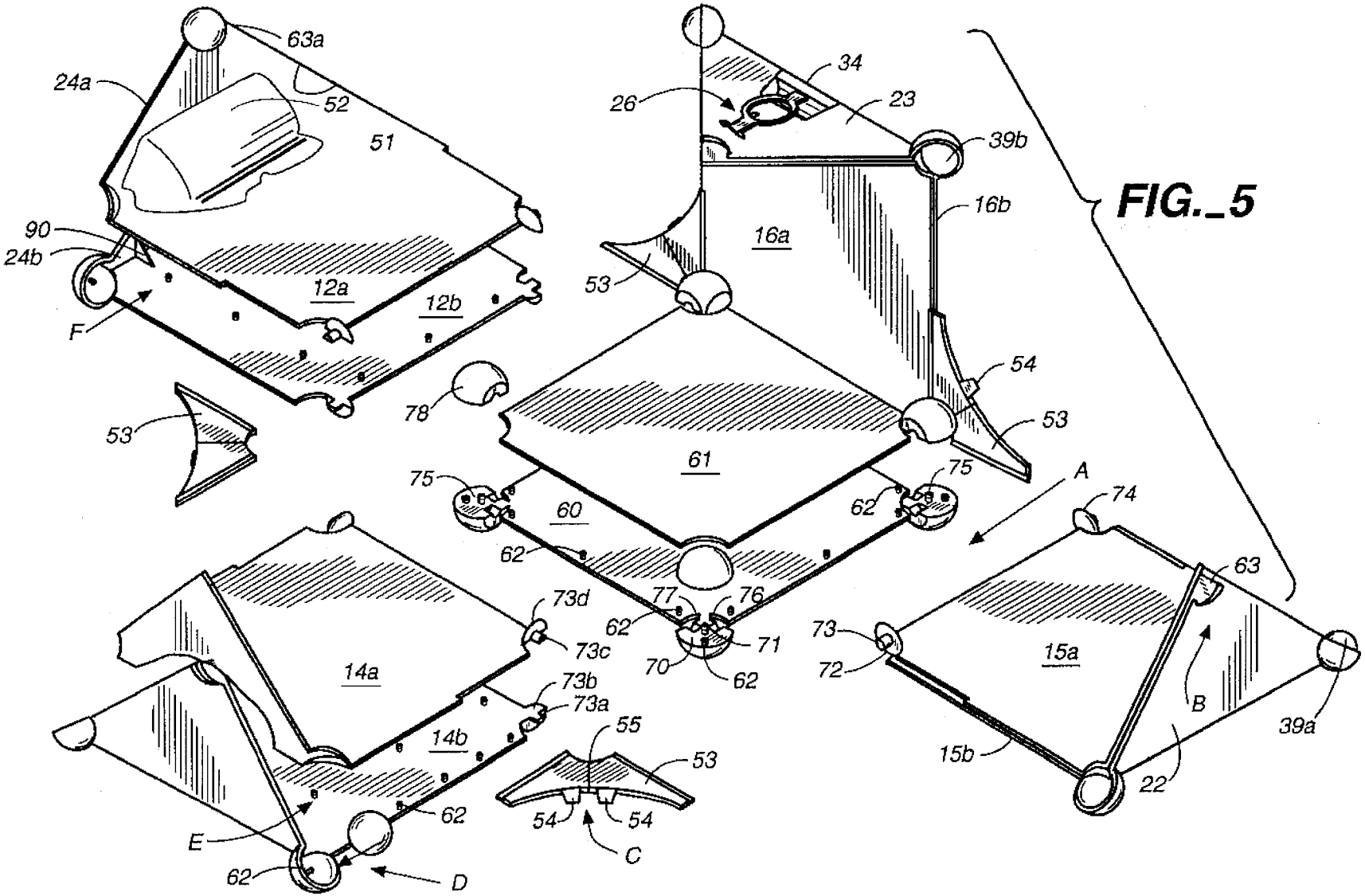
FIG. 5 is an exploded assembly view of the box assembly generally without the scenery on the inner panels.
Figure 6:
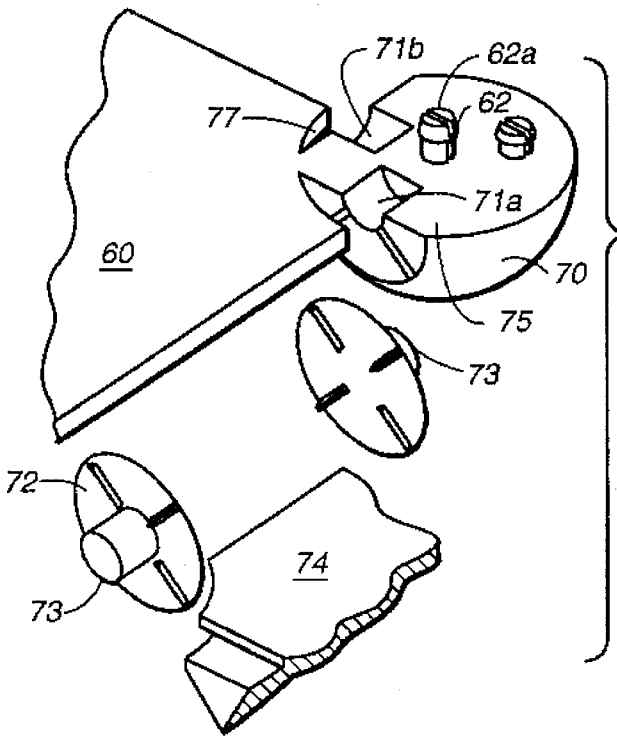
FIG. 6 is a perspective view of the hinge ball with panel position detents and cap snap-in at a typical position A in FIG. 5.
Figure 10:
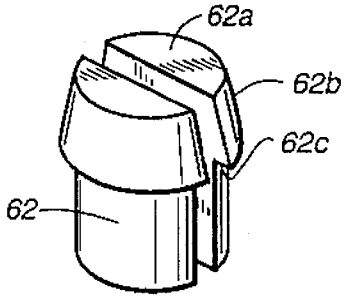
FIG. 10 is a perspective view of a detent at a typical position E in FIG. 5.

The ball segments are shown in detail in FIGS. 5 and 6. A hemisphere 70 integrally extends from the base panel 60 with an upwardly-facing flat surface 75. A pair of pin socket halves 71*a* and 71*b* extend orthogonal from each other in surface 75. The socket halves are sized to receive integral hinge pins 73 and 73*a* (FIG. 5) provided on facing bottom corners of adjacent side panels 14*b* and 15*b*. The pins 73 and 73*c* extend from integral semi-domed members 72 and 73*d* which are rotatable in semi-circular curved grooves 76 and 77 formed at the corners of panel 60 adjacent to the hemisphere 70. A second hemisphere 78 is snap-fitted onto surface 75 so that snap-in interlock members or attachments 62 in one of facing flat surfaces of the hemispheres snaps into a matching snap aperture in the other facing surface. The second hemisphere 78 also contains pin sockets matching and aligned with pin sockets 76 and 77 to receive pin half 73*c* and the top half of pin 73. The attachments 62 (FIG. 10) have flexible upright spaced arms 62*a* and a tapered head 62*b*. A reentrant end 62*c* thereof is snapable into a matching aperture in hemisphere 78 to hold the hemispheres together while capturing the hinge pin halves on bottom corners of adjacent side panels. A child would not be able to pull attachments 62 out from the matching apertures.

Figure 9:
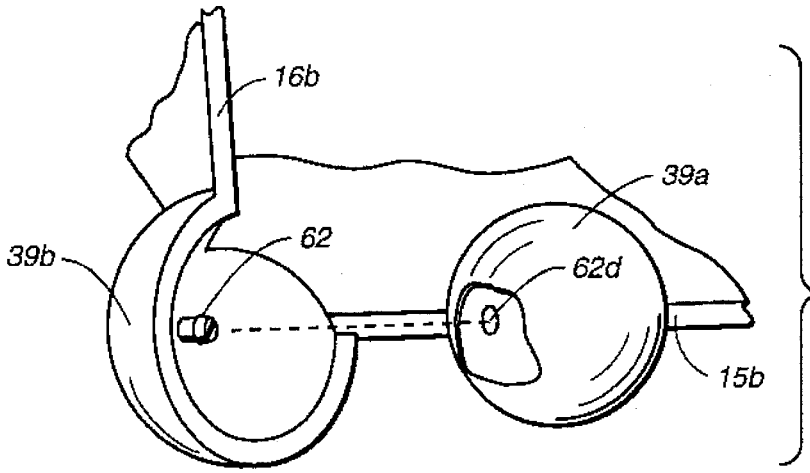
FIG. 9 is a perspective partially broken-away view of the snap-in ball and ball receptacle or shell at a position D in FIG. 5.

The upper corners of the side panels 12, 14, 15 and 16 each include a locking ball 25*a*, 25*b*, 25*c* and 25*d* (FIGS. 1 and 2) which serve to further lock each side panel and their integrally attached triangular member to adjacent side panels in the box closed position. Each top panel includes an open shell ball retainer at one top end and a closed ball at the other end such when the side panels are raised to close the box, the closed shell semi-ball 39*a* (FIG. 5) on side panel 15*b* interfits into and is snapped-into an open shell semi-ball 39*b* on side panel 16*b*. As in the bottom corner ball snap-in connections, snap-in attachments 62 extend from open shell 39*b* and snap-in receptacles 62*d* (FIG. 9) extend inwardly of ball segment 39*a*.

Figure 2:
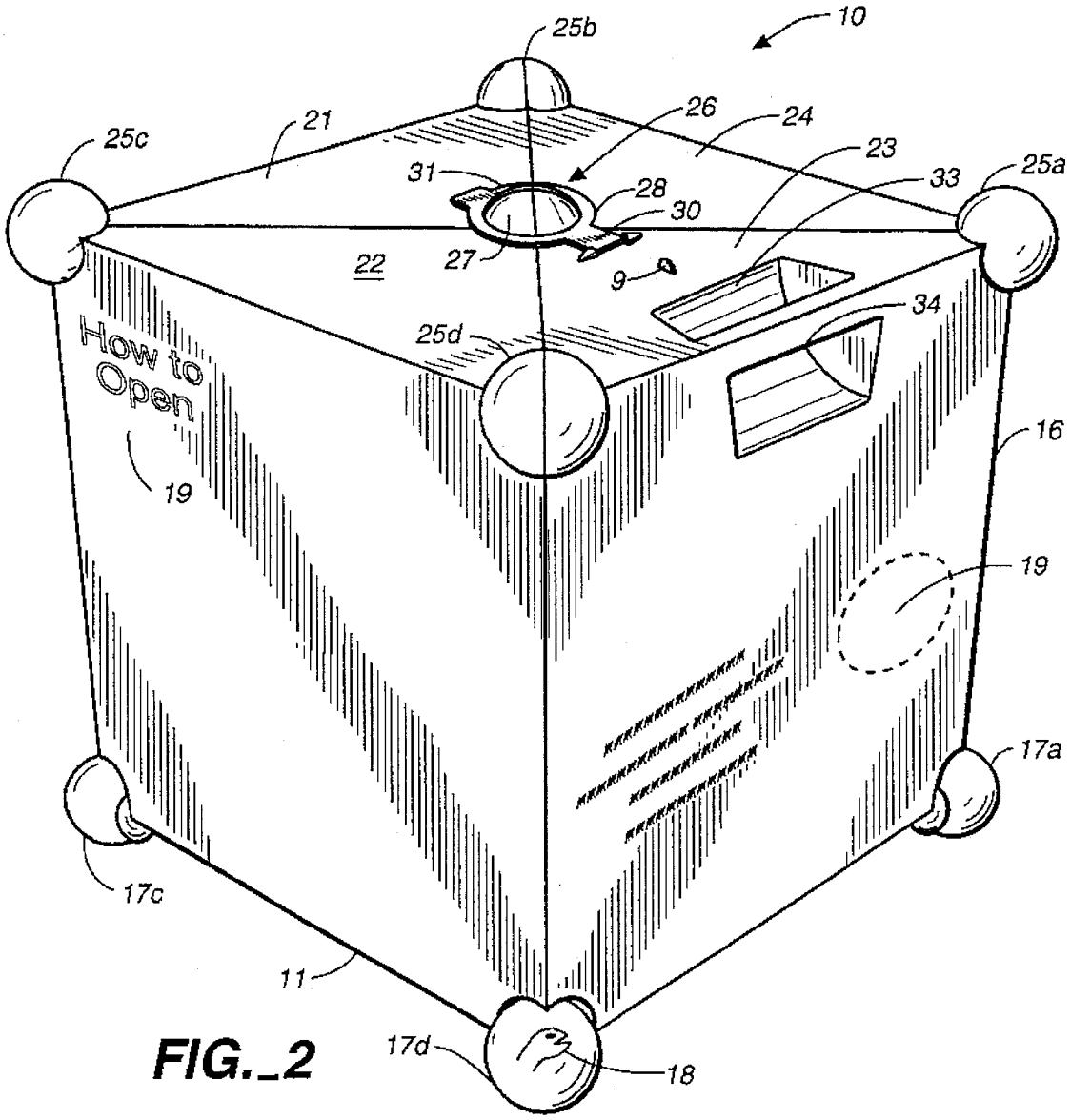
FIG. 2 is a perspective view of the rear of the folded box particularly showing the lifting and transport handle and instructional indicia.

The box assembly 10 as best seen in FIG. 2 also includes a handle formed by a molded indented finger groove 33 having a curved entrance and exit sized to receive the index and other fingers of the user. The grip handle extends at a median of the corner intersection between a side panel, e.g.

panel 16 and a triangular member, e.g. panel 23. An integral hand-graspable cross bar 34 permits the child or adult to easily pick-up and transport the closed diorama.

Suitable indicia 19 showing the Title of the diorama with suitable illustration such as a medieval castle and knights in armor on an exterior surface of a side panel, an illustration of the folded out diorama with children playing on another side panel exterior surface and a How to Open and other instructions or play suggestions are contained on yet other exterior surfaces of other panels. Animal heads 18 or objects may be molded-in-place on knobs 17. The external surfaces of the triangular members may also contain colorful illustrative panels and words and phrases.

Figure 3:
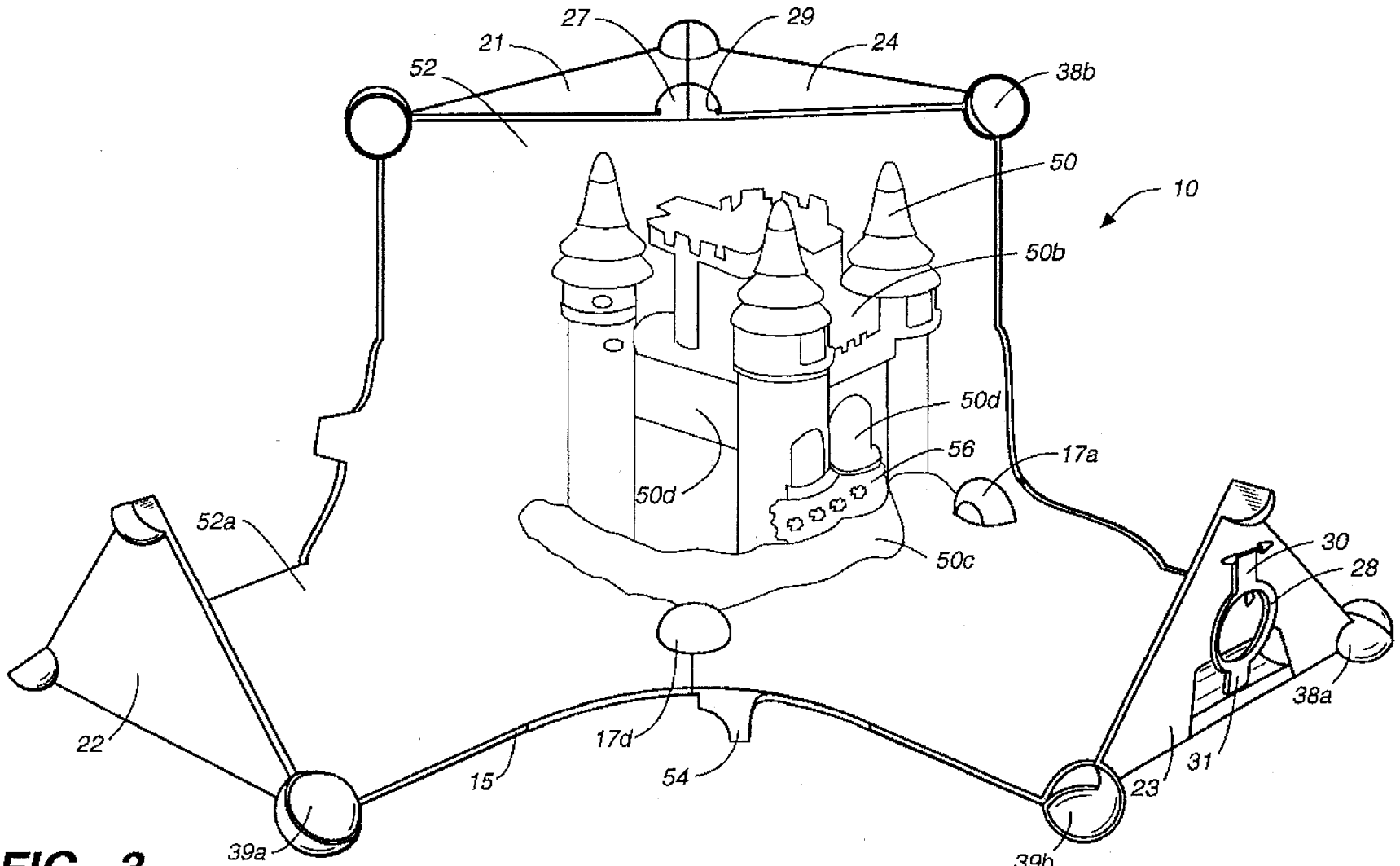
FIG. 3 is a perspective view of the diorama box in a partially unfolded mode.
Figure 4:
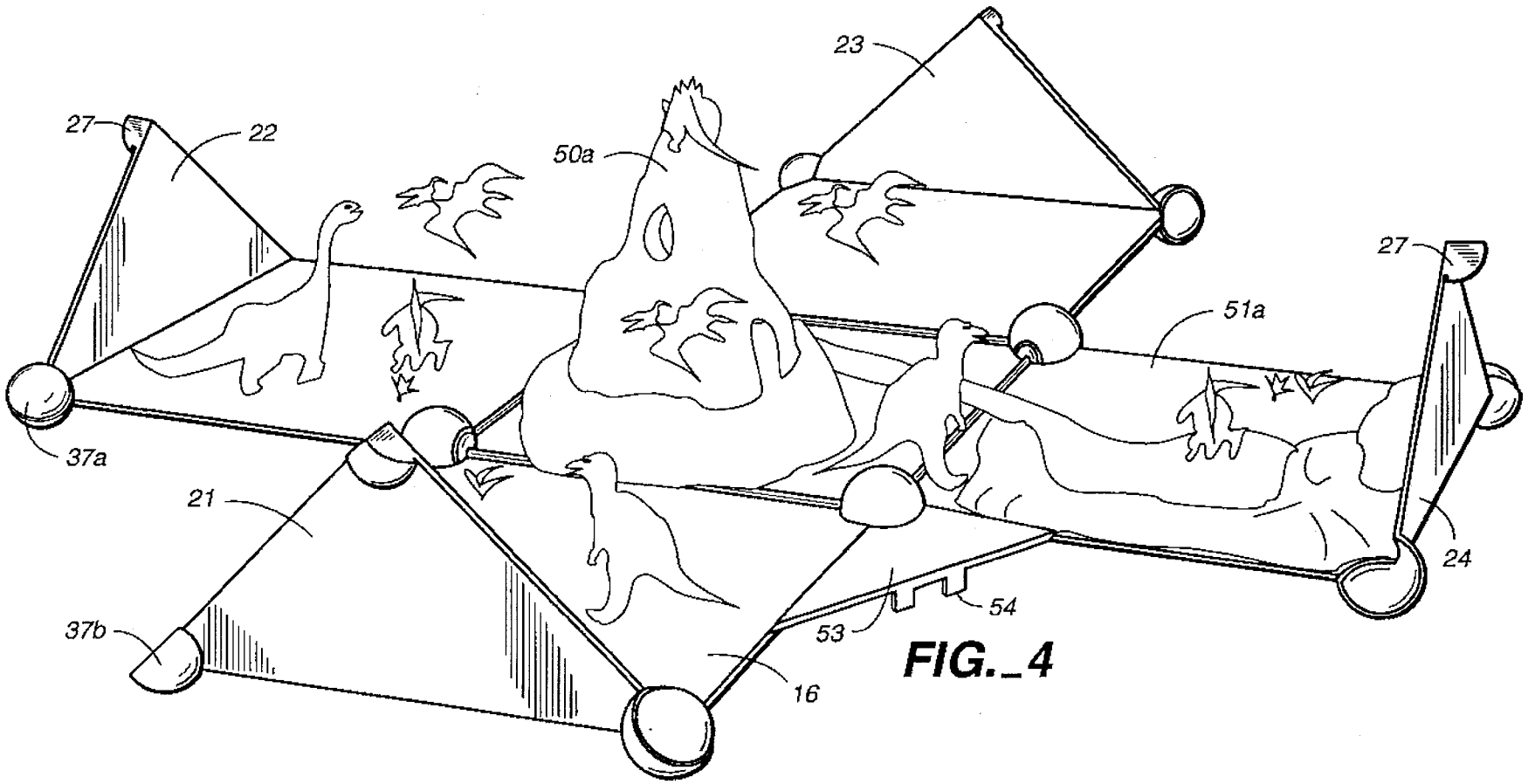
FIG. 4 is a perspective view of the box in a fully unfolded diorama mode.

After the latch loop 28 has been lifted from the locking dome groove 29 any one of the quarter domes 32 may be grasped and lifted upwardly to pivot the combined triangular member and side panel, e.g. member 22 and side panel 15, about the hinge hemispheres 70 and 78 at each bottom corner of the base panel 60. The other combined triangular members e.g. member 23 and side panel 16 are then unfolded as seen in FIG. 3 for a first play position. Particularly if two or more children are to take play positions around the diorama, all four side panels will be unfolded about the hinge members as seen in FIG. 4.

The central base panel normally mounts an impressive central structure such a tall castle 50 in a medieval diorama, or a volcano 50*a* in a dinosaur diorama, or a grandstand in a race-track diorama (not shown). Appropriate balconies 50*b* for placement of toy archers, toy swordsmen and the like and roads, a moat 50*c* and a drawbridge 50*d* for attacking horse-mounted toy knights may be provided in the former, for example. Hills, valleys, wells, outbuildings, trees, painted scenes or shrubbery 56 can be provided extending also to scenes and structures formed on the folded out side panels and also on the vertical backdrops at 52 and 52*a* provided by the folded out interior surfaces of the triangular members. The dioramic displays are heightened by the appearance of ball segments 17*a*, 17*b*, 17*c* and 17*d* in the dioramas and the complimentary open and closed ball shells 39*a* and 39*b* forming the support knobs for the unfolded diorama.

Folding wings 53 seen both in FIG. 5 (position C), FIG. 8 and FIGS. 15–17 have side apertures 62*e* snapped-onto snap-in panel attachments 62 on adjacent panels across the root angle formed by the adjacent panels. The wings 53 have a fold line 53*b* formed as a scribed slot which allow the wings to fold-up into the box when the side panels are raised from an unfolded position to a box closed position. Slots 53*a* also assist in the folding/unfolding action. A pair of wing tabs 54 or a single tab (FIG. 16) extending orthogonally from the wings act as further support for the diorama in the FIGS. 3 and 4 box unfolded positions. The wings fold up into the interior naturally due to their shape. The wings are hinged in three places. This allows them to fold together and into the box while the panels are being closed.

Figure 7:
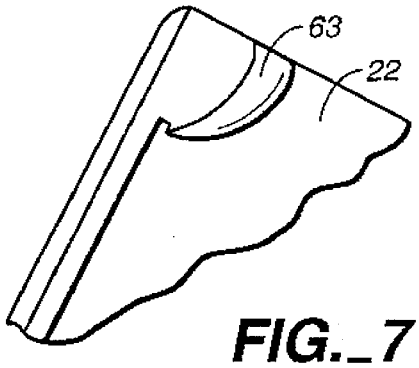
FIG. 7 is a perspective of apex of a panel up-right triangular member at position B in FIG. 5.
Figure 8:
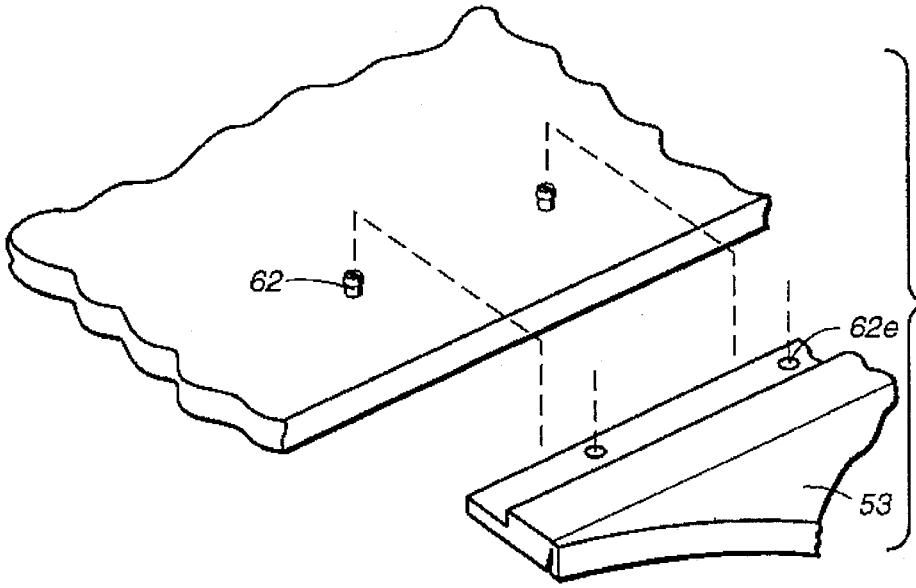
FIG. 8 is a perspective view of the folding wing snap-on assembly at a typical position C in FIG. 5.

FIGS. 5, 7 and 14 illustrate part of a temporary box locking mechanism. A radiused recess 63 or grooves 27*a* on the top side of three of the apices cooperates with a ridged tab extension 32*a* on the remaining apex which tab extension extends over three quarters of a disc. The tab is friction-fitted into the three radiused grooves or recesses in the closed position. The tab 31 of the locking ring 28 can be pulled up to release the tab 32*a* from the recesses 27*a* and allow unfolding of the side panels. Thus, at the apex of each upright backdrop triangular member there is a quarter dome shape that creates full dome once the toy is folded closed. This closed dome is intended as the main locking feature for the toy when it is closed. A flexible polyethylene loop with a grip tab fits over the dome and securely locks all four panels together. This makes the toy ready for storage or carrying. The individual quarter domes also exhibit extra features which facilitate the locking of the panels. One of the quarter domes has the ridged tab 29*a* (FIG. 14) molded into it. The other three panels feature a corresponding detented slot which fits over the tab when the panels are brought together. This feature provides a temporary locking mechanism for the panels in the closed position and adds stability to the quarter panels on the top of the toy. The corners, including surfaces 27*b*, of all the quarter domes are rounded to increase safety for the user when the panels are in the open position.

Figure 11:
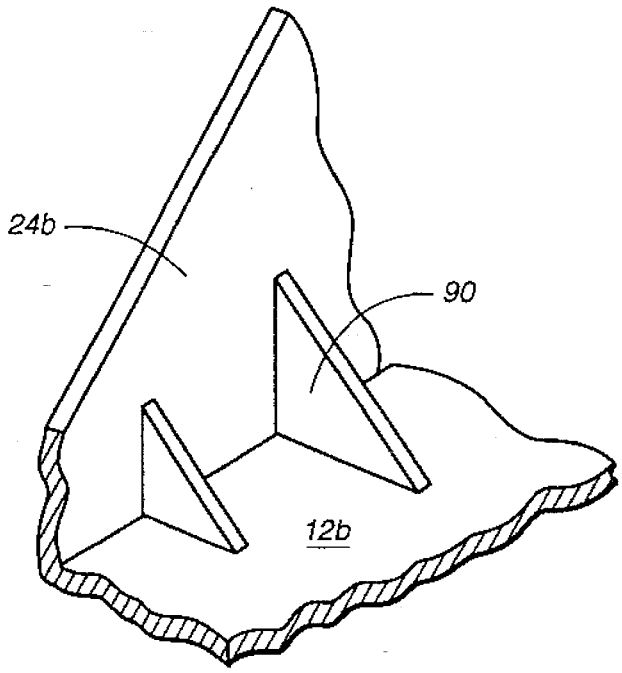
FIG. 11 is a perspective view of the support web for the triangular panel at a typical position F in FIG. 5.

FIGS. 5 and 11 illustrate additional or molded-in-place support fillets or webs 90 at a typical position F which afford additional support for and rigidity the triangular members and their associated panels so as to prevent breaking-off of the triangular members.

In a preferred embodiment as seen in FIG. 5 the box panel 11 is constructed of an outside panel 60 containing the hemispheric hinge elements and an inner base panel 61 generally of the same area as panel 60, the panels being nested together and assembled by the hinge elements 70 and 78 at each corner and by peripheral groupings of snap-in panel attachments 62 on the facing surfaces of the hemispheric hinge elements 70, 78. This permit use of a standard outside panel 60 for all dioramas and use of less complicated drop-in inside panels for the variety of scenes and structures to be displayed on the top of that inside panel 61. Likewise the side panels are constructed of inside panels 12*a*, 14*a*, 15*a* and 16*a* containing the scenes and structures and nested and snapped-on to the outer panels 12*b*, 14*b*, 15*b* and 16*b*. In FIG. 5 panels 12*a*–12*b* and 14*a*–14*b* are shown exploded while panels 15*a*–15*b* and 16*a* and 16*b* are shown as assembled double-thickness side panels. The semi-domed members 70, 78 will seat a half pin 73*a* on an inner side plate 14*b* and the other half pin 73*c* at a meshing outer side plate 14*a*.

The base panels, side panels, triangular members, and webs are preferably constructed of impact-grade polystyrene plastic and manufactured by conventional injection molding operations. The wall panels have a general wall thickness of about 3 mm. Polystyrene is lightweight, dimensionally stable, unaffected by moisture and elements can be snapped together for assembly or solvent or ultrasonically bonded. The assembled double panels afford twice the above thickness and provide for toy rigidity and stability. The folding wings are preferably made of polypropylene plastic to provide flexibility of the wings and integral bend hinges. The locking ring may be constructed of polyethylene plastic or a rubber-based material to allow a slight degree stretching so as to stretch over the locking dome and relax into the locking groove.

As seen in FIGS. 15–17, the folding wings 53 are folded inwardly about scored hinge lines at slots 53*b* and at 53*a* so that the wings fold into the box assembly, when for example, panels 15 and 16 are raised to close the box. The wings are at a shallow angle $\alpha$ of about 3° with each other when the toy is open as seen in FIG. 17. This enables the wings to fold easily into the toy without locking or jamming, when the side panels are being closed. The molded-in leg or tab 54 also clears the other half of the wings as the toy is being closed.

The above description of embodiments of this invention is intended to be illustrative and not limiting. Other embodiments of this invention will be obvious to those skilled in the art in view of the above disclosure.

I claim:

1. An unfolding and folding dioramic box assembly comprising:

an essentially flat first base panel for displaying a central scenic structure internally in a box assembly folded mode;

a series of essentially flat side panels for displaying scenic structure extending internally in a box assembly folded mode and outwardly in a box unfolded mode, said side panels being pivotable with respect to said base panel;

wherein each of said side panels includes an integral perpendicular member of triangular configuration fixedly extending from a top edge of each of said side panels in an unfolded mode, each of said perpendicular members having side edges which abut adjacent side edges of an adjacent perpendicular member in a box assembly folded mode to form a closed box top;

wherein said base panel and said side panels are pivotable about hinge members at facing peripheral edges thereof; and including a ridged tab extending from an apex of one of said triangular members and a detented slot extending from the apex of each of the other triangular members and wherein in the box top closing condition, the ridged tab is automatically inserted into said detented slots to temporarily hold the triangular members together in the box top closed condition.

2. An unfolding and folding diorama box assembly comprising:

a rectangular essentially flat first base panel displaying a central scenic structure internally in a box assembly folded mode and displayed on an unfolded mode, said base panel including a series of first hinge members;

a series of rectangular essentially flat side panels for displaying a scene, said scene being displayed internally in a box assembly folded mode and displayed outwardly in an unfolded mode, said side panels including a series of second hinge members, said second hinge members being pivotable with respect to said first hinge members such that said side panels are unfolded to be generally planar with said base panel;

a series of triangular members fixedly extending from a top edge of each of said side panels;

wherein side edges of said triangular members come together in a box assembly folded mode to form a generally closed box top; and wherein said first and second hinge members are first and second ball segment members interfitting in a box folded mode to form a portion of a spherical ball at each bottom corner of the base panel, said spherical ball portions forming box-supporting knobs at said box bottom corners.

3. The box assembly of claim 2 further including third ball sediment members at adjacent top corners of said side panels, each of said third ball segment members being in the form of a semi-ball open shell on one top corner of one side panel and an essentially semi-ball closed shell on a facing corner of an adjacent side panel such that the semi-ball open shells and the semi-ball closed shells are nestible together when the side panels are raised with respect to said base panel to form a folded box assembly.

4. The box assembly of claim 3 wherein said semi-ball open shells and said semi-ball closed shells are snapped together in a box assembly folded mode.

5. An unfolding and folding diorama box assembly comprising:

a rectangular essentially flat first base panel displaying a central scenic structure internally in a box assembly folded mode and displayed on an unfolded mode, said base panel including a series of first hinge members;

a series of rectangular essentially flat side panels for displaying a scene, said scene being displayed internally in a box assembly folded mode and displayed outwardly in an unfolded mode, said side panels including a series of second hinge members, said second hinge members being pivotable with respect to said first hinge members such that said side panels are unfolded to be generally planar with said base panel;

a series of triangular members fixedly extending from a top edge of each of said side panels;

wherein side edges of said triangular members come together in a box assembly folded mode to form a generally closed box top; and wherein a free apex of each of said triangular members include a quarter-ball segment, a latch groove in each of said quarter-ball segments, said groove extending circumferentially around said quarter-ball segments in a folded mode, and a flexible latch loop extending from a triangular member at a position adjacent to one of said quarter-ball segments, said loop being manipulatable into said circumferential groove to capture and hold said triangular members and side panels in a box assembly folded mode.

6. An unfolding and folding box assembly comprising:

a rectangular essentially flat first base panel displaying a central scenic structure internally in a box assembly folded mode and displayed on an unfolded mode, said base panel including a series of first hinge members;

a series of rectangular essentially flat side panels for displaying a scene, said scene being displayed internally in a box assembly folded mode and displayed outwardly in an unfolded mode, said side panels including a series of second hinge members, said second hinge members being pivotable with respect to said first hinge members such that said side panels are unfolded to be generally planar with said base panel;

a series of triangular members fixedly extending from a top edge of each of said side panels;

wherein side edges of said triangular members come together in a box assembly folded mode to form a generally closed box top;

wherein said first hinge members are integral with said base panel and said second hinge members are integral with said side panels; and wherein said first and second hinge members comprise first and second ball segment members including snap-in interlock members for interlocking said first ball segment members to said second ball segment members.

7. An unfolding and folding diorama box assembly comprising:

a rectangular essentially flat first base panel displaying a central scenic structure internally in a box assembly folded mode and displayed on an unfolded mode, said base panel including a series of first hinge members;

a series of rectangular essentially flat side panels for displaying a scene, said scene being displayed internally in a box assembly folded mode and displayed outwardly in an unfolded mode, said side panels including a series of second hinge members, said second hinge members being pivotable with respect to said first hinge members such that said side panels are unfolded to be generally planar with said base panel;

a series of triangular members fixedly extending from a top edge of each of said side panels;

wherein side edges of said triangular members come together in a box assembly folded mode to form a generally closed box top;

wherein said triangular members are integral with and at an orthogonal angle with respect to said side panels in seriatim in both the folded mode and unfolded mode;

further including a flexible wing extending between edges of each pair of adjacent side panels, said wings forming a curved scenic-containing extension of said central scenic structure in box assembly unfolded mode and being foldable in a box assembly folded mode; and wherein each of said wings are snapped into adjacent side panels.

8. An unfolding and folding box assembly comprising:

a rectangular essentially flat first base panel displaying a central scenic structure internally in a box assembly folded mode and displayed on an unfolded mode, said base panel including a series of first hinge members;

a series of rectangular essentially flat side panels for displaying a scene, said scene being displayed internally in a box assembly folded mode and displayed outwardly in an unfolded mode, said side panels including a series of second hinge members, said second hinge members being pivotable with respect to said first hinge members such that said side panels are unfolded to be generally planar with said base panel;

a series of triangular members fixedly extending from a top edge of each of said side panels;

wherein side edges of said triangular members come together in a box assembly folded mode to form a generally closed box top; and wherein said base panel includes an essentially flat rectangular inner panel assembled on said base panel, said inner panel containing said central scenic structure, and wherein each of said side panels includes an essentially flat inner side panel assembled thereon, said inner side panels displaying said scene.

9. An unfolding and folding dioramic box assembly comprising:

an essentially flat first base panel for displaying a central scenic structure internally in a box assembly folded mode;

a series of essentially flat side panels for displaying scenic structure extending internally in a box assembly folded mode and outwardly in a box unfolded mode, said side panels being pivotable with respect to said base panel;

wherein each of said side panels includes an integral perpendicular member of triangular configuration fixedly extending from a top edge of each of said side panels in an unfolded mode, each of said perpendicular members having side edges which abut adjacent side edges of an adjacent perpendicular member in a box assembly folded mode to form a closed box top;

wherein said base panel and said side panels are pivotable about hinge members at facing peripheral edges thereof; and in which said hinge members are ball segment members at bottom corners of said base panel and said side panels.

10. The box assembly of claim 9 further including ball segment locking members at upper corners of said side panels for locking said upper corners together.

* * * * *